United States Patent [19]

Wangeby et al.

[11] 4,257,461

[45] Mar. 24, 1981

[54] DEVICE FOR FEEDING TREES IN TREE DELIMBING MACHINES

[75] Inventors: Percy Wangeby, Norrala; Nils-Erik Pahlsson, Malmö, both of Sweden

[73] Assignee: Kockums Industri AB, Fack, Sweden

[21] Appl. No.: 26,880

[22] Filed: Apr. 4, 1979

[30] Foreign Application Priority Data

Apr. 10, 1978 [SE] Sweden ..... 7804011

[51] Int. Cl.[3] ..... B27L 1/00

[52] U.S. Cl. ..... 144/2 Z; 144/246 A; 144/246 F; 144/309 AC; 198/624

[58] Field of Search ..... 198/624; 144/2 Z, 3 D, 144/34 R, 34 A, 34 E, 309 AC, 246 R, 246 A, 246 C, 246 D, 246 E

[56] References Cited

U.S. PATENT DOCUMENTS

| | | | |
|---|---|---|---|
| 3,329,184 | 7/1967 | Longert | 144/2 Z |
| 3,724,518 | 4/1973 | Zehavi et al. | 144/2 Z |
| 3,797,541 | 3/1974 | Kurelek et al. | 144/3 D |
| 3,833,034 | 9/1974 | Menzel et al. | 144/3 D |
| 3,844,399 | 10/1974 | Sellers, Jr. et al. | 144/246 F |
| 3,994,327 | 11/1976 | Bergholm et al. | 144/2 Z |
| 3,999,582 | 12/1976 | Allen et al. | 144/2 Z |
| 4,081,007 | 3/1978 | Loigerot | 144/246 C |

FOREIGN PATENT DOCUMENTS

| | | | |
|---|---|---|---|
| 2805727 | 8/1978 | Fed. Rep. of Germany | 144/2 Z |
| 604685 | 4/1978 | U.S.S.R. | 144/2 Z |
| 634933 | 11/1978 | U.S.S.R. | 144/246 F |

*Primary Examiner*—W. Donald Bray

[57] ABSTRACT

The total force required for feeding a tree through a delimbing machine is provided simultaneously by the combined actions of feed rolls and a longitudinally displaceable beam. The feed rolls are mounted on the frame of the machine and are movable towards and away from the tree trunk that is to be delimbed. The beam has gripping means for inserting the tree between the feed rolls. In one embodiment of the invention, at least one of the feed rolls is formed in two adjacent sections with one of the sections having projections on the periphery thereof and the other of the sections being provided with a resilient surface in order to minimize damage to the wood.

8 Claims, 5 Drawing Figures

DEVICE FOR FEEDING TREES IN TREE DELIMBING MACHINES

Most present tree delimbing machines, so-called processors, are provided with spike rolls for feeding the trees through the delimbing machine. In a few types of delimbing machines the feeding is performed otherwise. In order to feed large trees and trees with thick limbs through the delimbing machine great feeding forces are required and consequently also great clamping forces between the feed rolls and the tree trunk. Hereby the spikes or the studs of the rolls may penetrate so deeply into the tree trunk that damage is caused to the wood, which is revealed either at the sawing by preventing maximum utilization of the tree trunk or after the sawing by certain damage remaining in the sawn timber.

Recently manufacturers of limbing machines have attempted to find solutions of the tree feeding problem with the aim of eliminating said spike damage. New types of studs providing a smaller penetration depth have been proposed and it has also been suggested to use air-filled rubber wheels instead of spike or stud rolls for the feeding operation. However, these solutions are not completely satisfactory as in both cases the feeding tends to become unreliable since the rolls have an increased tendency to slip against the surface of the tree trunk. In modern delimbing machines there is generally arranged a sensor for automatic length measurement and cutting usually connected to the feed rolls. A slip occurring will interfere with the length measurement so that the tree trunk is cut at the wrong position. The present invention is intended for use in delimbing machines of the type generally referred to as beam processors, i.e. delimbing machines equipped with an extendable and retractable beam with gripping means for gripping the undelimbed trees and feeding them into the delimbing machine, and the object of the invention is to provide a method and a device for such machines for safely feeding the trees through the machine without the risk of wood damage being caused by the feed members.

A device for feeding trees in delimbing machines of the type comprising a machine frame, driven feed rolls for the trees mounted on said frame and movable in a direction towards and away from the tree trunk, and a beam or the like, with gripping means for gripping the trees and inserting them between said feed rolls, is characterized in that the drive means for the displacement of the beam in the longitudinal direction thereof and the drive means for the feed rolls are adapted to be controlled automatically in such a manner that both the feed rolls and the beam simultaneously contribute to provide the total force required for feeding the tree through the machine.

Thus, since the feed rolls have only to provide part of the total force for feeding the tree, the rolls need not be provided with conventionally formed spikes or studs, which might cause wood damage, but instead the rolls may be provided with shorter and/or blunter studs or may be completely without studs and instead be provided with a mantle surface of friction increasing material and/or be provided with a friction increasing profile providing the necessary capability of transferring forces between the roll and the tree trunk without causing damage to the latter. The feed rolls may for instance be provided with a mantle of rubber or other elastic material, formed with ridges or patterns so as to increase the gripping capability thereof when in contact with the tree trunk. The drive motors for both the feed rolls and the beam are preferably hydraulic motors and in such case the necessary control of the motors for the synchronization of the feeding movements of the feed rolls and the beam is provided by an arrangement of hydraulic valve and fluid restriction means. In the delimbing of trees or tree parts that are so thin or so shaped that they are only suitable as pulp wood the feeding is performed in the simplest and best manner by means of conventional spike rolls, since in this case there are no disadvantages of importance with the damage possibly caused by the spikes, which damage in addition is reduced with reduced traction force required on the tree trunk. In this case it would be both unnecessary and unsuitable to perform the feeding of trees by means of both the feed rolls and the beam. Therefore, in one preferred embodiment of the invention special feed rolls are used, each being axially divided into two adjacent sections, viz. one axially short section, which at the periphery thereof presents conventional spikes or studs, and one axially long section, which is not provided with such spikes or studs at its periphery but instead presents a mantle surface of a material or a profile so chosen that no wood damage can occur, when the roll section is in action against the tree trunk for the feeding thereof. The axial extension of the roll section provided with spikes may amount to at least 5 cm, preferably at least 8 cm. In the feeding of a tree through the machine, which is usually performed with the butt end foremost, the roll sections provided with spikes can initially be used together with the beam to jointly feed the tree. The last thin part of the tree trunk can then be guided so that it will be fed solely by the sections of the feed rolls provided with spikes, i.e. without any assistance of the beam. In general the feed rolls are arranged on vertical shafts, which are supported by arms, which are pivotable so as to spacing the feed rolls from each other in order to allow laying down the butt end of a tree between the feed rolls. While the tree is initially fed by means of the roll sections not provided with spikes and the feed beam, the tree will slide on a support and gradually sink or be drawn downwards towards the roll sections provided with spikes, whereby said sections will be caused to engage the tree trunk when the thickness thereof has been reduced to such a degree, that thereafter the tree trunk is only suitable for use as pulp wood.

The invention is described hereinbelow more closely with reference to the accompanying drawings, which illustrate one embodiment of the invention.

Figure 1:
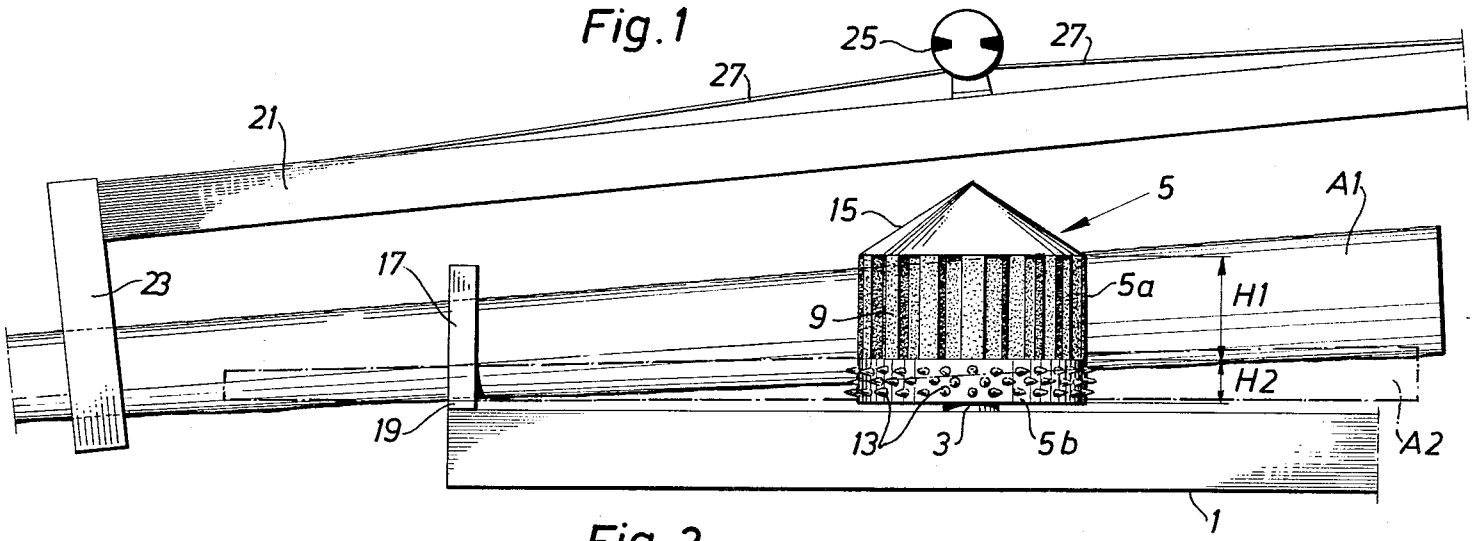
FIG. 1 and FIG. 2 are a side and plane view, respectively, of a tree processor, embodying the present invention.
Figure 2:
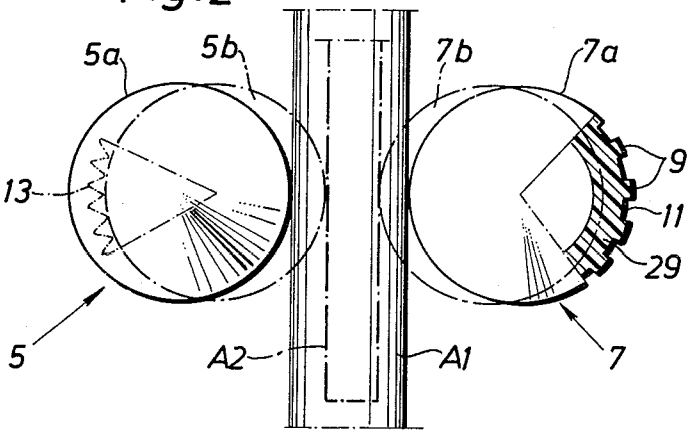

The device shown in FIGS. 1 and 2 is intended to be used as part of a delimbing machine, which may be of a conventional type, e.g. a vehicle-based machine of the tree processor type. The frame of the machine is designated with 1 and 3 designates each shaft of two feed rolls 5 and 7 for the feeding of the tree. The shafts 3 extend substantially in a vertical direction and each of the shafts is supported by an arm which is swingably supported by a shaft likewise extending vertically, said arms being power actuated, e.g. by means of hydraulic cylinders, and interconnected in such a manner known per se that the rolls 5 and 7 can be moved towards and away from the tree trunk A1 or A2 inserted between the rolls, mutually to the same extent, so that the center line of all tree trunks fed will always be positioned in a vertical center plane between the rolls in the direction of feed of the tree. During the feeding operation the tree is supported by a support member 19, which may be a delimbing knife member, included in a set of knives of a delimbing device 17, the design of which is not shown in detail, since it may be conventional. For inserting the tree trunks there is provided a beam 21 with a gripping head 23, said beam being adapted to be extended in the longitudinal direction thereof for gripping an undelimbed tree and retracted for inserting the butt end of the tree between the feed rolls 5 and 7. The movement of the beam is performed by drive means, e.g. a hydraulic motor 25 and cables 27 in a manner known per se. Each of the feed rolls 5 and 7 consists of two sections each 5*a*, 5*b* and 7*a*, 7*b*, respectively, located adjacent one another in the longitudinal direction of the rolls. The lower section 5*b*, 7*b* is provided on the mantle surface thereof with outwardly extending spikes or studs 13 in a manner known per se, so as to secure a very good grip or engagement with the tree trunk to be fed. The upper section 5*a*, 7*a* is not provided with any spikes or studs but is instead formed with a mantle 29 of a material which is resilient or elastic as compared with steel, said mantle at the external surface thereof being formed with axially extending ridges or ribs 9 with intermediate grooves 11 to improve the engagement with the tree trunk. By means of such selection of material and shape an increased capacity of force transmission between the feed rolls and the tree trunk is obtained, without the risk of the feed rolls causing undesirable damage to the wood of the trunk to be fed. A rubber or plastic material, with or without reinforcement, may be chosen as material for the mantle 29.

A1 in FIG. 1 designates a thick trunk which is intended for saw timber. This trunk is fed by means of the sections 5*a* and 7*a* of the feed rolls, with the assistance of the beam 21, while the trunk is supported by the support means 19. During the feeding the trunk is drawn right, i.e. the inclination towards the horizontal plane illustrated is reduced gradually, so that the position of the trunk approaches the horizontal position. The feeding is interrupted at intervals for the cutting of the trunk into suitable lengths intended for saw timber.

It can be seen from the drawings that the trunk A1, when it is fed horizontally in the machine while sliding on the support 19 will go free from engagement with the spikes 13 of the lower roll sections 5*b*, 7*b*, and therefore there is no risk of wood damage caused by said spikes.

When feeding a thin trunk A2 which may be intended for pulp wood the upper sections 5*a*, 7*a* of the rolls will not be in action for the feeding operation as illustrated direct in FIG. 1, the feeding being instead carried out only by the lower sections 5*b*, 7*b* provided with spikes. If during such feeding wood damage should be caused to the trunk, this is a minor disadvantage, since, anyway, the wood is intended to be cut into chips for pulping.

The axial dimensions or heights H1 and H2, respectively, of the upper and lower sections, respectively, of the rolls will depend on the lower limit to be set for the thickness of the tree trunks in order that the tree trunks shall be utilized more economically as saw timber than as pulp wood. The lower limit for the thickness of saw timber is usually about 10 to 12 cm, but the limit may vary depending on the circumstances. Under these conditions the height H2 of the lower roll sections may for instance be at most about 12 cm and at least about 5 cm. H2 is preferably about 6 to 10 cm. For the roll sections 5*a*, 7*a* there are no special conditions regarding the axial length thereof, the only condition being that said length should be sufficient for the rolls being capable of feeding the thickest trunks of the trees to be harvested.

Figure 3:
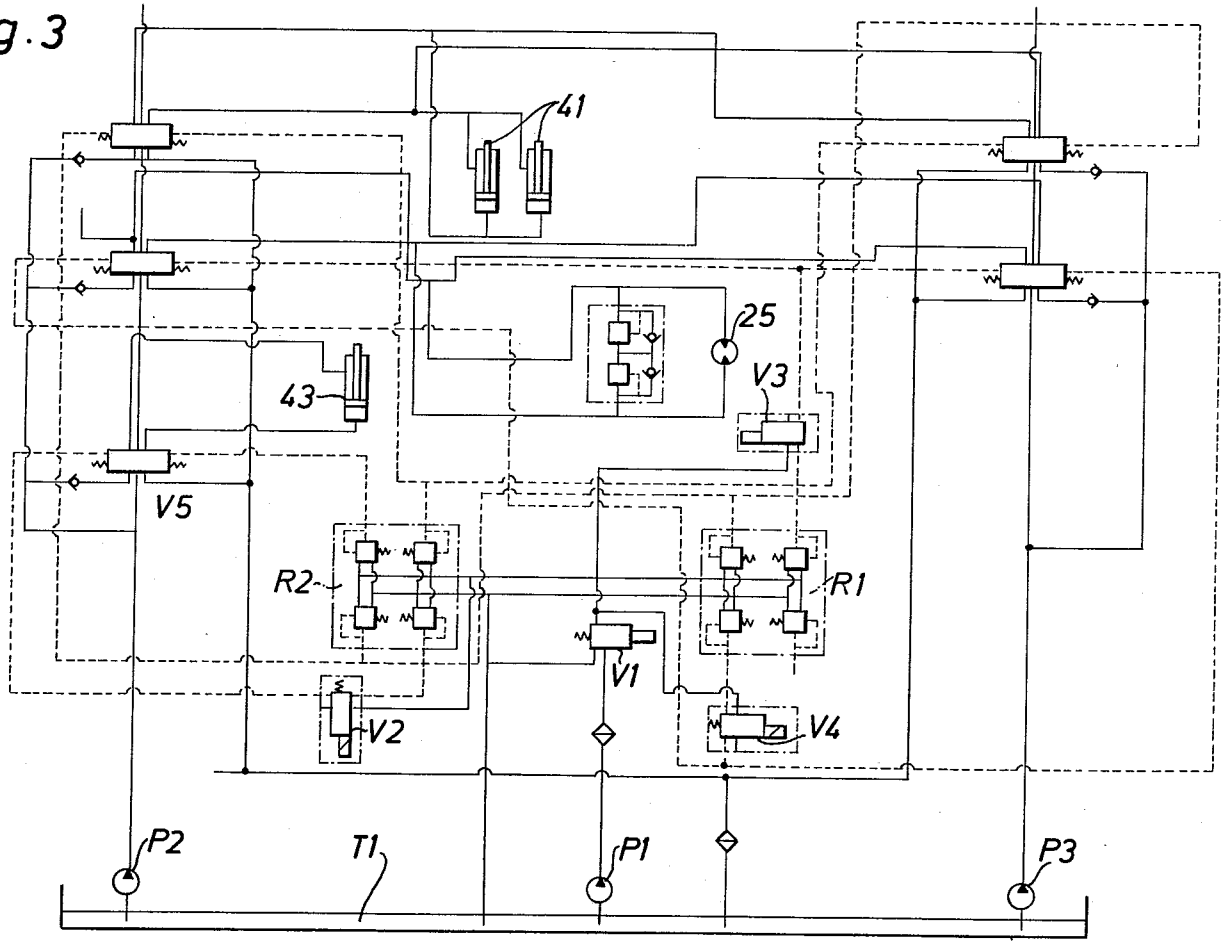
FIG. 3 shows the hydraulic flow diagram for the operation of the beam and gripping means of the processor.

FIG. 3 is the flow diagram of the hydraulic system for the operation of the beam and the gripping means. The flow diagram is conventional and will therefore be described only in brief hereinbelow.

Figure 4:
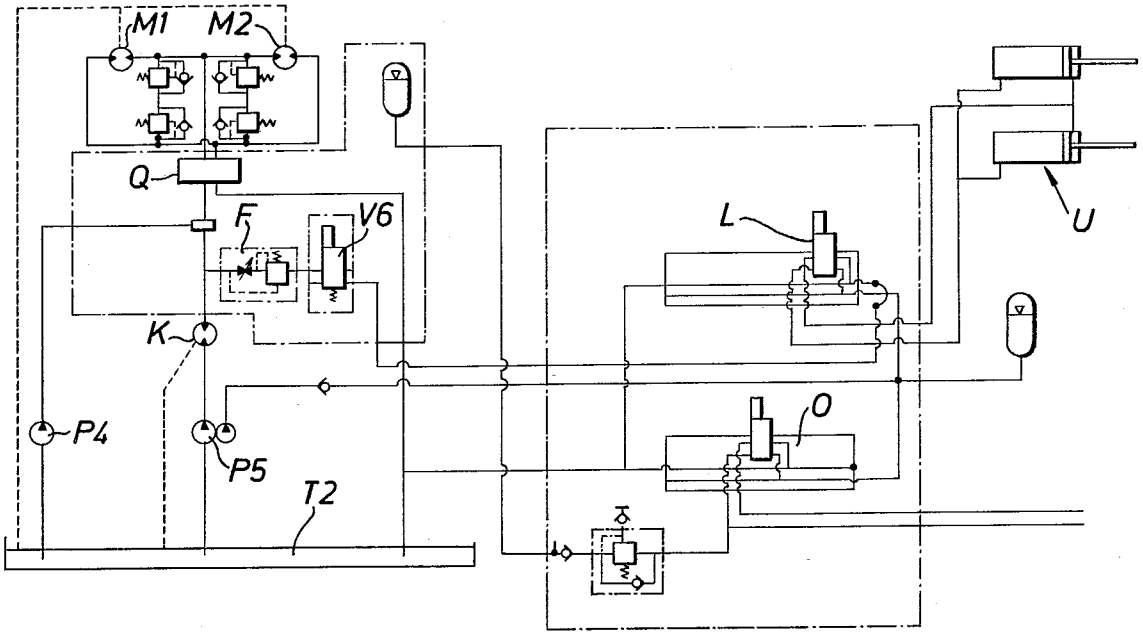
FIG. 4 shows the hydraulic flow diagram for the operation of the feed rolls of the processor and FIG. 5 shows the electric circuit diagram for the operation of the valves comprised in the flow diagrams of FIGS. 3 and 4.

The system is supplied with fluid be means of pumps P1, P2 and P3 from a tank T1. By means of two operation control assemblies R1 and R2 to be actuated by the machine operator, the extension and the retraction of the beam as well as the raising thereof and the operation of the gripping means can be controlled. The extension and the retraction of the beam through the hydraulic motor 25 is controlled by means of the assembly R1 through the electrically actuated valves V3 and V4. The gripping means mounted on the beam are operated by means of a hydraulic cylinder 43 and are controlled by the operating assembly R2 through the electrically actuated valve V2. The raising and lowering of the beam is effected by means of hydraulic pistons 41 and controlled in a conventional manner, which will not be described more closely, since this is not necessary for the explanation of the present invention. In FIG. 4 M1 and M2 designate the hydraulic motors for the respective feed rolls which are swingable towards and away from a tree to be processed in the delimbing machine. The motors are supplied with pressurized fluid by means of the pump P4 from the tank T2. By means of the valve Q operable by the machine operator the feed rolls can be driven in one or the other direction of rotation and be stopped. K indicates the drive motor for a device for cutting the delimbed tree trunks. This motor is supplied with pressurized fluid from a pump P5 and controlled by means of the electrically actuated valve device O. U designates hydraulic pistons for the swinging inwards and outwards of the arms to which the feed rolls are mounted. The movement of said arms is controlled by means of the electrically actuated valve L. An adjustable restriction F having self-locking properties is connected between the discharge side of the pump P4 of roll motors and the tank T2. It is by means of the restriction F, which can be connected and disconnected by means of the valve V6 that the synchronization of the feeding motion of the rolls M1, M2 and the feeding motion of the beam are performed.

FIG. 4 shows the electric circuit diagram for the control means which are essential in connection with the present invention. 31 designates one terminal of an electric power source, not illustrated, from which current is supplied through a fuse. 32 designates a switch having two stationary contacts 32' and 32''. A limit position sensor 33 having a break contact 33' is connected to a relay 34 having a contact 34' which is connected through a time delay relay 35 to a relay 36 which comprises a movable contact 36'. 37 designates a second relay, having a movable contact 37'. In FIG. 4 there are also shown relays 38, having a movable contact 38', and 39, having a movable contact 39', for the closing and the interruption of electrical current through the electrically actuated valves V3 and V4, respectively. In FIG. 4 there are also shown the electrically actuated valves V5 and V6. All valves are provided with protection diodes in a manner known per se.

Figure 5:
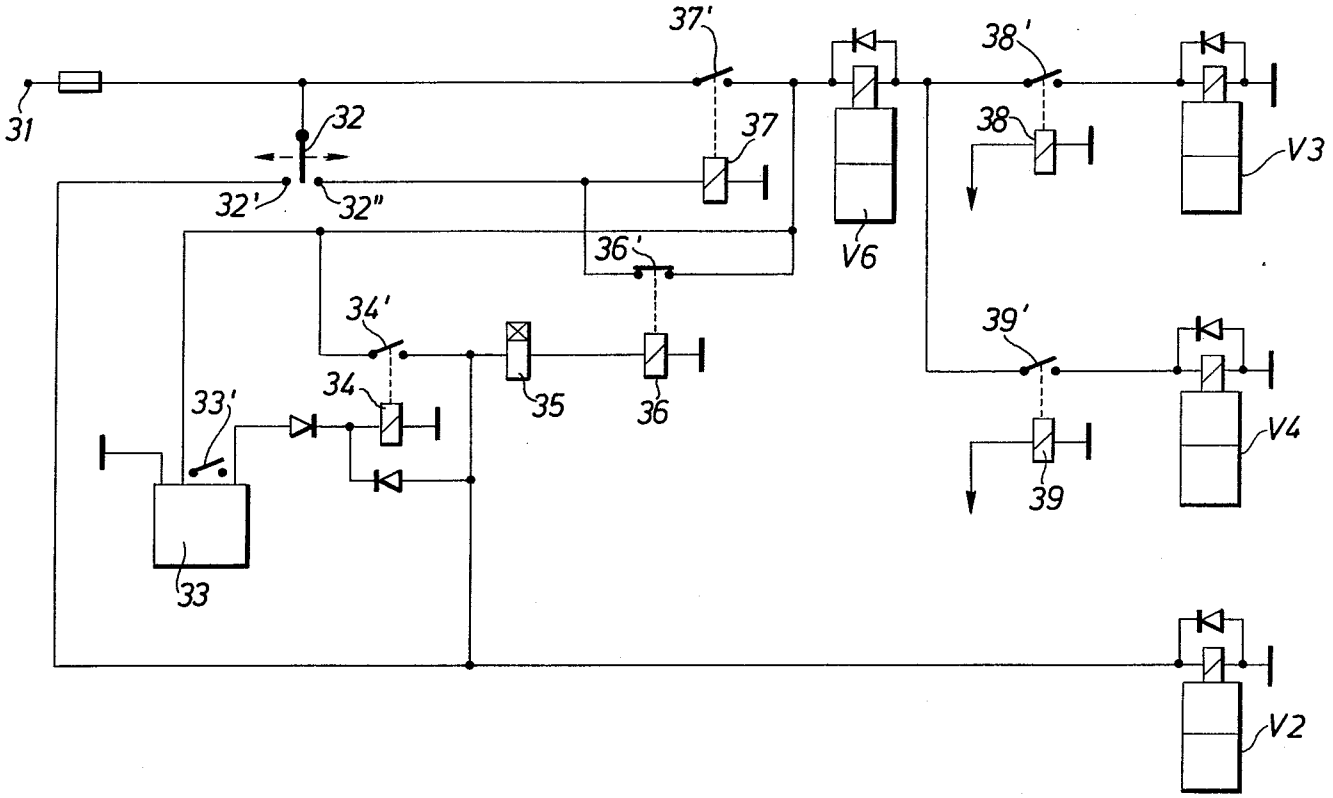

The device according to the embodiment illustrated operates in the following manner in the treatment of a trunk A1 according to FIG. 1 intended to be sawn into timber. When the tree has been inserted between the upper sections 5*a* of the feed rolls in the manner illustrated, the switch 32 is actuated according to FIG. 5, so that the current source 31 is connected to the stationary contact 32 whereby current flows through the relay 37, closing the contact 37' thereof, the current circuit of the relay being thus self-locked through the closed contact 36' of the relay 36. A signal for the retraction of the beam is applied to the relay 38, so that the contact 38' thereof is closed and the valve V3 is switched for driving the beam motor 25 in a direction of rotation corresponding to retraction of the beam. Simultaneously the relay V6 receives current and is switched for connection into circuit of the restriction F, FIG. 4, whereby is secured that the feeding speed of the feed rolls and the feeding speed of the beam will be identical. When the retraction of the beam is to be stopped for cutting or when it has reached its innermost position, a limit position sensing means, generally indicated at 33 in FIG. 5, is actuated automatically, so that the contact 33' thereof is closed and the current passes through the relay 34, whereby the contact 34' thereof is closed. Hereby current flows through the relay V5, which controls the gripping means 23, so that said gripping means starts to loosen its grip around the tree trunk. When after a time interval the gripping means has been opened to a sufficient degree, said time interval being determined by the time relay 35, the relay 36 till receive current and open the contact 36', whereby the holding circuit of the relay 37 is interrupted and the relay will be without current, since the contact 32 is of the spring-back type and is in the position illustrated in FIG. 5 after the contact-making to the stationary contacts 32' and 32'' respectively. When current through the relay 37 is interrupted, the contact 37' is opened and the current through the relays V6 and V3 is interrupted, whereby the beam will stop. Also the current through the relay V5 for the operation of the gripping means will be interrupted.

The beam with the gripping means can now be moved outwards to collect a new trunk length, which is performed by the actuation of the relay 39 and the setting of the switch 32 to the fixed contact 32'', the latter operation causing the relay 37 to be energized and self-locked through the re-closed contact 36', whereby current will flow through the valve V6, which has again been switched from the position shown in FIG. 4 to the alternate position in which the restriction F is connected into circuit. When the beam has been extended to the desired length it is stopped and the gripping means is closed again around the tree trunk. During the extension of the beam the tree trunk is kept still-standing by means of the feed rolls which are stopped and, if desired, special holding means are caused to become operative. Since the relay V6 is in series both with the contact 38' of the relay 38 and the contact 39' of the relay 39, it is possible, through reversing the direction of rotation of the feed rolls by means of the valve Q, FIG. 4, to allow said rolls to rotate backwards and to feed the tree trunk backwards with the same speed as the reverse movement of the beam, whereby, if the gripping means is closed, the tree trunk is moved backwards by the aid of both the feed rolls and the beam.

After the desired number of trunk lengths has been cut by means of the cutting device coupled to the motor K, which is controlled by the valve 0, the rest of the tree may be utilized as pulp wood. For the continued feeding operation there is therefore no need of assistance from the beam but the feeding may be performed only by means of the feed rolls and, specifically, by means of the lower sections 5*b* thereof, whereby the feeding speed, in addition, may be higher than at the forward feeding of the thicker trunk portions. The higher feeding speed of the rolls is obtained automatically by the restriction F, FIG. 4, being disconnected by means of the valve V6, which occurs automatically, when the beam is stopped.

The invention is not limited to the embodiment illustrated and described and the method of operation thereof described, but may be realized in many alternative ways within the scope of the invention.

We claim:

1. A delimbing machine comprising a frame, means on said frame for delimbing a tree trunk feed rolls with drive means for feeding a tree trunk through the delimbing means said feed rolls being mounted on said frame and being movable in a direction towards and away from the tree trunk and a beam having gripping means for gripping the tree trunks and inserting them between said feed rolls, said delimbing machine being provided with means for automatically controlling the drive means for the displacement of the beam in its longitudinal direction in relation to the drive means for the feed rolls in such a manner that the feed rolls as well as the beam contribute simultaneously to provide the total force required for feeding the tree trunk through the machine.

2. The apparatus as claimed in claim 1, wherein said feed rolls are driven by hydraulic motor means and wherein means are included for adapting the speed of rotation of the feed rolls to the rate of displacement of the beam by discharging a predetermined quantity of hydraulic fluid from a hydraulic pump connected to the hydraulic motor means of the feed rolls.

3. The apparatus as claimed in claim 1, further including automatically operating means for disengaging the gripping means from the tree trunk when the rate of displacement of the beam does not coincide with the feeding speed of the feed rolls.

4. The apparatus as claimed in claim 1, wherein at least one of the feed rolls comprises two adjacent sections, one of said sections being provided at the periphery thereof with projections, the other of said sections being provided with a resilient surface, the material of which is selected so as to provide a substantial engagement with the tree trunk without damaging the wood.

5. The apparatus as claimed in claim 4, wherein said section having the projections thereon is axially short relative to the other of said section.

6. The apparatus as claimed in claim 1, wherein at least one of the feed rolls comprises two adjacent sections one of said sections being provided at the periphery thereof with projections, the other of said sections being provided with a resilient surface, the profile of which is selected so as to provide a substantial engagement with the tree trunk without damaging the wood.

7. The apparatus as claimed in claim 6, wherein said section having said projections is relatively short as compared to said other section.

8. The apparatus as claimed in claim 6, wherein said resilient, profiled surface is patterned with ridges to improve the gripping capability thereof.

* * * * *